United States Patent [19]

VanAllan et al.

[11] 3,955,982

[45] May 11, 1976

[54] PHOTOTHERMOGRAPHIC ELEMENT, COMPOSITION AND PROCESS

[75] Inventors: James A. VanAllan; Ronald H. Ericson; Lorenzo F. Costa, all of Rochester, N.Y.

[73] Assignee: Eastman Kodak Company, Rochester, N.Y.

[22] Filed: Feb. 12, 1975

[21] Appl. No.: 549,235

Related U.S. Application Data

[63] Continuation-in-part of Ser. No. 443,891, Feb. 19, 1974.

[52] U.S. Cl. ..... 96/48 HD; 96/67; 96/109; 96/114; 96/114.1; 96/114.6

[51] Int. Cl.[2] ..... G03C 1/02; G03C 5/24; G03C 1/34

[58] Field of Search ..... 96/48 HD, 114.1, 67, 96/114, 114.6, 109

[56] References Cited

UNITED STATES PATENTS 3,824,103 7/1974 Pierce et al. ..... 96/109

*Primary Examiner*—David Klein
*Assistant Examiner*—Louis Falasco
*Attorney, Agent, or Firm*—R. E. Knapp

[57] ABSTRACT

A stabilizer precursor comprising a certain halo organic compound having a halogen substituent which is a chlorine, bromine or iodine atom in a photothermographic element or composition provides improved post-processing stability. This stabilizer precursor is useful in photothermographic materials, for example, comprising photosensitive silver salt and an oxidation-reduction image-forming combination comprising a heavy metal salt oxidizing agent with a reducing agent. Certain of the halo organic compounds are incubation antifoggants for certain of the photothermographic materials.

30 Claims, No Drawings

PHOTOTHERMOGRAPHIC ELEMENT, COMPOSITION AND PROCESS

This application is a continuation-in-part application of U.S. application Ser. No. 443,891 filed Feb. 19, 1974 of VanAllan, Ericson and Costa.

BACKGROUND OF THE INVENTION

1. Field of the Invention

This invention relates to certain halo stabilizer precursors in photothermographic elements, compositions and processes to provide improved stability. In one of its aspects it relates to a photothermographic element comprising (a) photosensitive silver halide in association with (b) an oxidation-reduction image-forming combination comprising (i) a heavy metal salt oxidizing agent with (ii) an organic reducing agent, (c) a polymeric binder, and (d) a certain halo organic stabilizer precursor as described herein. In another of its aspects it relates to a photothermographic composition comprising the described stabilizer precursors. A further aspect relates to a method of developing a stable image in a photothermographic element comprising the described oxidation-reduction image-forming combination with photosensitive silver halide and the described halo organic stabilizer precursors by overall heating the exposed photothermographic element.

2. Description of the State of the Art

It is known to obtain an image in a photosensitive element by so-called dry processing with heat. The photothermographic element employed for providing such an image can contain a reducing agent, a light-insensitive silver salt of an organic acid, such as silver behenate, as an oxidizing agent and a low concentration of photographic silver halide. Such photothermographic elements are described, for example, in U.S. Pat. No. 3,457,075 of Morgan et al., issued July 22, 1969; U.S. Pat. No. 3,152,904 of Sorensen et al., issued Oct. 13, 1964; British Pat. Specification No. 1,161,777 published Aug. 20, 1969; U.S. Pat. No. 3,707,377 of Tiers et al., issued Dec. 26, 1972 as well as in *Research Disclosure*, January, 1973, pages 16–21.

In a photothermographic material one of the main difficulties involves post-processing stability. Because heat developable photographic elements are suitable for so-called dry processing with heat and are designed to eliminate a fixing step which normally would remove undeveloped silver, it is necessary that a means be provided for post-processing stabilization to enable room-light handling.

Several means have been proposed to answer the need for post-processing stability of photothermographic elements, such as (1) washing with water to remove undeveloped silver salts, (2) heating to release Bronstead or Lewis acid such as HCL, fluoride or HF from incorporated compounds such as m-nitrobenzenesulfonyl chloride, para-toluenesulfonic acid urea addition complex or p-acetamidobenzenediazonium fluoroborate and (3) chelation of the oxidizing agent with, for example, salicylaldoxime or benzotriazole as described in U.S. Pat. No. 3,152,904 of Sorensen et al., issued Oct. 13, 1964. Another method proposed for solving the problem of post-processing instability is to provide a photothermographic combination in which the oxidation-reduction image-forming combination is on one sheet of material and the latent image forming photographic silver halide is on a separate sheet. The sheets are separated after exposure such as described in U.S. Pat. No. 3,152,904. A further means proposed for stabilization involves swabbing a 1% solution of phenylmercaptotetrazole onto the surface of the overall heated photothermographic material or rubbing benzotriazole into the surface of the coating. These proposed means for stabilization are not useful for large volume handling of heat developable photographic materials.

It has also been proposed to provide stabilized images in heat developable materials by treating the developed image with a solution containing certain thiol or thione compound stabilizers. This is described, for example, in U.S. Pat. No. 3,617,289 of Ohkubo et al., issued Nov. 2, 1971. One of the compounds proposed for this solution stabilization is 1-phenyl-5-mercaptotetrazole. Unfortunately, the addition of this compound to photographic silver compositions provides undesired desensitization at concentrations which produce stabilization and toning of a developed image.

Another means of stabilization of an image in a photothermographic material is described in U.S. Pat. No. 3,839,041 of Hiller, issued Oct. 1, 1974. Certain stabilizer precursors which are azole thioethers or blocked azolinethiones are employed in photothermographic materials according to the description in these applications. An example of a stabilizer precursor proposed in photothermographic materials is 5-methoxycarbonylthio-1-phenyltetrazole. Unfortunately, this compound does not always provide the desired increased stability of a heat developed image.

Another means for post-processing stabilization of certain photothermographic materials is described in U.S. Pat. No. 3,707,377 of Tiers et al., issued Dec. 26, 1972. Certain polyhalogenated organic oxidizing agents, such as tetrabromobutane, are described in certain heat developable photographic materials to provide post-processing stabilization. Unfortunately, multihalogenated image stabilizer precursors, such as tetrabromobutane, do not stabilize certain photothermographic materials as efficiently as monohalo compounds. This is illustrated by comparing the results in following Example 7 with results in following Example 11. Certain monohalo compounds can provide surprisingly improved stabilization without providing significantly decreased maximum density.

Halogenated organic compounds have been employed in photographic materials for various purposes, such as antifoggants. Monohalogenated organic antifoggants for photographic emulsions are described, for example, in U.S. Pat. No. 3,128,187 of Sagal et al., issued Apr. 7, 1964; U.S. Pat. No. 3,232,762 of Ford et al., issued Feb. 1, 1966; U.S. Pat. No. 2,732,303 of Morgan et al., issued Jan. 24, 1956; U.S. Pat. No. 2,835,581 of Tinker et al., issued May 20, 1958 and U.S. Pat. No. 3,271,154 of Dersch, issued Sept. 6, 1966.

There has been a continuing need for photothermographic materials, especially photothermographic materials comprising an image-forming combination containing photosensitive silver halide in association with an oxidation-reduction image-forming combination comprising an oxidizing agent comprising a silver salt of a long-chain fatty acid with an organic reducing agent and a polymeric binder, which has improved post-processing image stability, that is reduced background density and desired maximum density, when employing a halogen containing stabilizer precursor. There has also been a need to provide improved incubation antifoggants for such silver halide photothermographic materials.

SUMMARY OF THE INVENTION

The described improvements are provided in a photothermographic element or composition as described by employing as a halogen containing organic stabilizer precursor, a stabilizing concentration of a halo stabilizer precursor, represented by the formula:

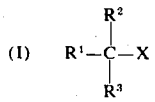

(I)

wherein X is chloro, bromo or iodo; $R^1$, $R^2$ and $R^3$ are the same or different and each is hydrogen, alkyl, such as alkyl containing 1 to 10 carbon atoms including methyl, ethyl, propyl or octyl; hydroxyalkyl, such as hydroxyalkyl containing 1 to 10 carbon atoms, including hydroxymethyl, hydroxyethyl and hydroxyhexyl; acyloxyalkyl, such as acyloxyalkyl containing 2 to 10 carbon atoms; nitro; nitroalkyl, such as nitroalkyl containing 1 to 10 carbon atoms, including nitromethyl, nitroethyl and nitropropyl; aryl, such as aryl containing 6 to 12 carbon atoms including phenyl and naphthyl; acyl, such as acyl of the formula $R^4$—CO— wherein $R^4$ is alkyl containing 1 to 5 carbon atoms including methyl, ethyl, propyl and butyl, or aryl containing 6 to 12 carbon atoms, such as phenyl and naphthyl; amido, such as amido represented by the formula

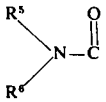

wherein $R^5$ and $R^6$ are the same or different and each is hydrogen, alkyl containing 1 to 5 carbon atoms, such as methyl, ethyl and propyl, phenyl or naphthyl; sulfonyl represented by the formula $R^7$ — $SO_2$— wherein $R^7$ is alkyl containing 1 to 5 carbon atoms, such as methyl, ethyl and propyl, or aryl, such as aryl containing 6 to 12 carbon atoms, such as phenyl, naphthyl or tolyl; and wherein, at least one of $R^1$, $R^2$ and $R^3$ is a stabilizer precursor activating substituent, preferably carbonyl, nitrophenyl, nitro, acyl, amido or sulfonyl.

Alkyl, aryl, hydroxyalkyl, acyloxyalkyl, nitrophenyl, acyl, amido and sulfonyl as employed herein include substituents on the defined groups which do not adversely affect stabilization or desired properties of photothermographic materials according to the invention. Suitable substituents include, for example, chloro, bromo, methoxy, phenyl, hydroxy, nitro and the like.

A stabilizer precursor activating substituent as employed herein is intended to mean a substituent which provides sufficient activity to the described halogen containing compound to release an active moiety in the photothermographic element. Typical activating substituents are carbonyl, sulfonyl, nitrophenyl and nitro groups.

The described improvements are provided, for example, in the photothermographic element comprising a support having thereon a layer comprising (a) photosensitive silver halide in association with (b) an oxidation-reduction image-forming combination comprising (i) a heavy metal salt oxidizing agent, typically a silver salt of a long-chain fatty acid, such as silver behenate and silver stearate with (ii) an organic reducing agent, such as a sulfonamidophenol reducing agent, (c) a polymeric binder for the described layer, such as poly(vinyl butyral) and (d) a halogenated organic stabilizer precursor as described.

DETAILED DESCRIPTION OF THE INVENTION

A variety of halogenated organic stabilizer precursors, as described, can be employed according to the invention to provide improved post-processing stability without adversely affecting desired properties of the photothermographic material.

Different tests can be employed to determine whether compounds or materials are useful image stabilizer precursors depending upon the particular photothermographic element and composition, desired image, processing conditions and the like. One test which can be employed for certain photothermographic elements is described in the following Example 1. In this test, the compound, after incorporation in the photothermographic element and after imagewise exposure and overall heating of the element as described in Example 1, should prevent buildup of background density or minimum density above 0.10 density unit more than the original minimum density without undesired stain and without significantly adversely affecting maximum density.

It is believed that the desired halo organic compounds are precursors of the moiety, compound or material which is formed and combines with silver ions or silver atoms to prevent undesired instability due to room-light exposure. However, the exact mechanism of stabilization is not fully understood. The described stabilizer precursors are compounds which do not prevent a redox reaction upon imagewise exposure and heat-processing of the described photothermographic materials, but the stabilizing moiety or material formed prevents background discoloration of the unexposed regions of the photothermographic material due to room-light exposure.

Many of the described halo organic compounds according to the invention provide reduced fog in a photothermographic material as described prior to imagewise exposure of the photothermographic material. The described halo compounds thus provide antifoggant action. The antifoggant action is provided in the photothermographic material under incubation conditions, i.e., conditions of temperatures and humidities above normal storage temperatures and humidities. Many of the described halo organic compounds are termed incubation antifoggants for photothermographic materials as described.

One class of useful stabilizer precursors according to the invention comprises an alpha-monohaloketone represented by the formula:

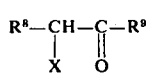

wherein X is chloro, bromo or iodo; $R^8$ is hydrogen, alkyl containing 1 to 10 carbon atoms, such as methyl, ethyl, propyl, butyl, pentyl or octyl, acyl containing 1 to 10 carbon atoms, such as acetyl, propionyl, butyryl and pentanoyl, and aryl containing 6 to 12 carbon atoms, such as phenyl and naphthyl; $R^9$ is amino, alkyl containing 1 to 10 carbon atoms, as described, and aryl containing 6 to 12 carbon atoms, such as phenyl and naphthyl.

Another class of stabilizer precursors according to the invention comprises a monohalo sulfonyl compound represented by the formula:

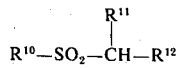

wherein $R^{10}$ is aryl, such as aryl containing 6 to 12 carbon atoms, such as phenyl, tolyl or naphthyl; $R^{11}$ is chloro, bromo or iodo; $R^{12}$ is hydrogen, alkyl, such as alkyl containing 1 to 5 carbon atoms, including methyl, ethyl and propyl; amido, such as amido represented by the formula

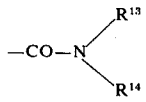

wherein $R^{13}$ and $R^{14}$ are the same or different and each is alkyl containing 1 to 5 carbon atoms, phenyl, tolyl or hydrogen.

Another class of stabilizer precursors according to the invention comprises a monohalo-nitro lower alkane stabilizer precursor, such as a monohalo-nitro lower alkane represented by the formula:

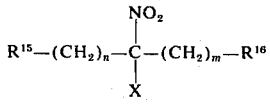

wherein X is chloro, bromo or iodo; *m* and *n* are each 1 to 5; $R^{15}$ and $R^{16}$ are the same or different and each is hydroxyl, an ester or a sulfonyl group represented by the formulas:

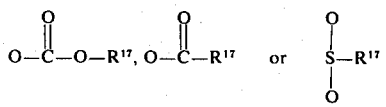

wherein $R^{17}$ is aryl, such as aryl containing 6 to 12 carbon atoms, including phenyl, tolyl and naphthyl, or alkyl, such as alkyl containing 1 to 5 carbon atoms, including methyl, ethyl, propyl and butyl.

Useful stabilizer precursors as described include the following monohalo compounds:

2-bromo-2-phenylsulfonylacetamide
2-bromoacetophenone
α-chloro-p-nitrotoluene
2-bromo-2-phenylacetophenone
2-bromo-1,3-diphenyl-1,3-propanedione
α-bromo-2,5-dimethoxyacetophenone
α-bromo-γ-nitro-β-phenylbutyrophenone
2-bromo-2-p-tolylsulfonylacetamide
α-iodo-γ-nitro-β-phenylbutyrophenone
α-bromo-p-nitrotoluene
2-bromo-4′-phenylacetophenone
2-chloro-4′-phenylacetophenone
α-bromo-m-nitrotoluene
2-bromo-2-nitro-1,3-propanediol
1,3-dibenzoylomy-2-bromo-2-nitropropane
2-bromo-2-nitromethylene bis(phenylcarbonate)

and compounds which contain more than one halogen atom represented by the formulas:

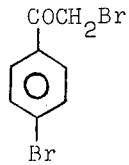

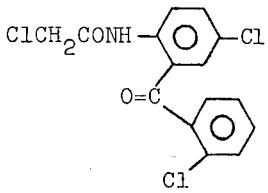

$ClCH_2COCH_2Cl$

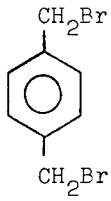

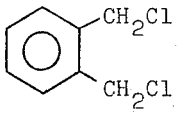

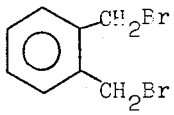

The compound 1,3-dibenzoyloxy-2-bromo-2-nitropropane is also known as 1,3-(2-bromo-2-nitro-trimethylene)dibenzoate.

The described halogenated organic stabilizer precursors can be prepared by methods known in the art. For example, the parent organic compound can be halogenated employing, for example, bromine or chlorine. The resulting halogenated compounds can be purified, if desired, employing purification procedures known in the art.

The described halogenated organic compound stabilizer precursors of the invention are useful in a variety of photothermographic materials.

The useful concentration of stabilizer precursor according to the invention will depend upon different factors such as the particular photothermographic element, processing temperatures, particular components of the photothermographic element, desired image, desired image stability, whether the stabilizer precursor is to be used to provide incubation antifoggant activity or post-processing stabilization activity and the like. A useful concentration of stabilizer precursor according to the invention is about 0.01 moles to about 1.0 moles of the stabilizer precursor per mole of total silver in the photothermographic material. An especially useful concentration range is about 0.05 moles to about 0.5 moles of the described stabilizer precursor per mole of total silver in the photothermographic element. When combinations of stabilizer precursors are employed according to the invention, the total concentration of stabilizer precursors is within the described concentration range. The optimum concentration useful can be determined based on the described factors.

Typical photothermographic materials in which the stabilizer precursors of the invention are useful are described, for example, in U.S. Pat. No. 3,457,075 of Morgan et al., issued July 22, 1969; U.S. Pat. No. 3,152,904 of Sorensen et al., issued Oct. 13, 1964; U.S. Pat. No. 3,429,706 of Shepard et al., issued Feb. 25, 1969; U.S. Pat. No. 3,672,904 of DeMauriac, issued June 27, 1972 and U.S. Pat. No. 3,801,321 of Evans et al., issued Apr. 2, 1974.

The stabilizer precursors of the invention are especially useful in photothermographic materials comprising (a) an oxidation-reduction image-forming combination comprising (i) silver behenate, with (ii) a sulfonamidophenol reducing agent, (b) photosensitive silver halide, (c) a poly(vinyl butyral) binder, and a spectral sensitizing dye. The photothermographic materials according to the invention can also contain a toning agent, also known as an activator-toning agent, such as succinimide, N-hydroxy-1,8-naphthalimide and 1-(2H)-phthalazinone. Such a photothermographic material in the absence of the stabilizer precursors of the invention is described, for example, in *Research Disclosure*, January, 1973, pages 16–21.

An especially useful embodiment of the invention is a photothermographic element comprising a support having thereon a layer comprising (a) an oxidation-reduction image-forming combination comprising (i) silver behenate with (ii) a sulfonamidophenol reducing agent, (b) photosensitive silver halide, (c) a polymeric binder, (d) a spectral sensitizing dye, (e) a toning agent, such as succinimide or N-hydroxy-1,8-naphthalimide, and (f)) a stabilizing concentration of alpha-bromo-grammma-nitro-beta-phenylbutyrophenone, 2-bromo-2-p-tolylsulfonylacetamide, 2-chloro-4′-phenylacetophenone, 2-bromo-2-nitro-1,3-propanediol, 1,3-dibenzoyloxy-2-bromo-2-nitropropane, or alpha-chloro-p-nitrotoluene.

The described photothermographic materials according to the invention comprise a photosensitive component which is photosensitive silver halide. In the photothermographic materials it is believed that the photographic silver halide or a component resulting from the photographic silver halide acts as a catalyst for the described oxidation-reduction image-forming combination. A typical concentration range of photosensitive silver halide is from about 0.01 mole to about 20.0 moles of photosensitive silver halide per mole of silver salt oxidizing agent, for example, per mole of silver behenate. Other photosensitive silver salts can be used in combination with the photosensitive silver halide if desired. Useful photosensitive silver salts include silver-dye complexes. Preferred photosensitive silver halides are silver chloride, silver bromide, silver bromoiodide, silver chlorobromoiodide or mixtures thereof. Very fine-grain photosensitive silver halide is especially useful although coarse or fine-grain photosensitive silver halide can be employed if desired. The photosensitive silver halide can be prepared by any of the procedures known in the photographic art. Such procedures and forms of photosensitive silver halide are described, for example, in the *Product Licensing Index*, Volume 92, December 1971, publication 9232 on page 107, paragraph I. the photosensitive silver halide according to the invention can be unwashed or washed, can be chemically sensitized, can be protected against the production of fog and stabilized against loss of sensitivity during keeping, as described in the above *Product Licensing Index* publication.

The photothermographic elements and compositions according to the invention comprise an oxidation-reduction image-forming combination which contains a heavy metal salt oxidizing agent, typically a silver salt of a long-chain fatty acid. Such heavy metal salt oxidizing agents are resistant to darkening upon illumination. Typically useful silver salts of long-chain fatty acids are those containing about 17 to 30 carbon atoms. Compounds which are useful silver salt oxidizing agents include: silver behenate, silver stearate, silver oleate, silver laurate, silver hydroxystearate, silver caprate, silver myristate and silver palmitate. Silver salts which are not silver salts of long-chain fatty acids are useful heavy metal salt oxidizing agents. Such silver salt oxidizing agents which are useful include, for example, silver benzoate, silver benzotriazole, silver terephthalate, silver phthalate and the like. Non-silver heavy metal salt oxidizing agents that are useful are, for example, gold stearate, mercury behenate, gold behenate and the like. Combinations of heavy metal salt oxidizing agents can be used if desired.

The described photothermographic elements and compositions can comprise various reducing agents. Suitable reducing agents which can be employed with the described stabilier precursors include substituted phenols and naphthols, for example, bis-beta naphthols. Suitable bis-beta-naphthols include, for example, 2,2′-dihydroxy-1,1′-binaphthyl, 6,6′-dibromo-2,2′-dihydroxy-1,1′-binaphthyl, 6,6′-dinitro-2,2′-dihydroxy-1,1′-binaphthyl and/or bis-(2-hydroxy-1-naphthyl) methane. Other reducing agents which can be employed in photothermographic elements, according to the invention, include polyhydroxybenzenes such as hydroquinone, alkyl-substituted hydroquinones such as tertiary butylhydroquinone, methylhydroquinone, 2,5-dimethylhydroquinone and 2,6-dimethylhydroquinone; catechols and pyrogallols, chloro-substituted hydroquinones such as chlorohydroquinone or dichlorohydroquinone; alkoxy-substituted hydroquinone such as methoxyhydroquinone or ethoxydroquinone; aminophenol reducing agents, such as 2,4-diaminophenols and methylaminophenols; ascorbic acid reducing agents such as ascorbic acid, ascorbic acid ketals and ascorbic acid derivatives; hydroxylamine reducing agents; 3-pyrazolidone reducing agents such as 1-phenyl-3-pyrazolidone and 4-methyl-4-hydroxymethyl-1-phenyl-3-pyrazolidone and the like. Combinations of reducing agents can be employed if desired.

Especially useful reducing agents which can be employed in the photothermographic materials according to the invention are sulfonamidophenol reducing agents as described in *Research Disclosure*, January, 1973, pages 16–21. One especially useful class of sulfonamidophenol reducing agents is represented by the formula:

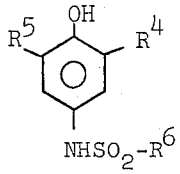

wherein $R^6$ is phenyl, naphthyl, methylphenyl, thienyl, quinolinyl, thiazyl, or alkyl containing 1 to 4 carbon atoms, such as methyl, ethyl, propyl or butyl; $R^4$ is hydrogen, $R^6SO_2NH$—, alkoxy containing 1 to 4 carbon atoms, such as methoxy, ethoxy, propoxy and butoxy, bromine or chlorine; $R^5$ is hydrogen, bromine, chlorine, alkyl containing 1 to 4 carbon atoms, as described, or alkoxy containing 1 to 4 carbon atoms, such as methoxy, ethoxy and propoxy. $R^4$, $R^5$ and/or $R^6$ can contain substituent groups which do not adversely affect the reducing properties of the described sulfonamidophenol reducing agents or the desired sensitometric properties of the photothermographic elements and materials of the invention. Examples of substituent groups which can be present are alkyl containing 1 to 3 carbon atoms such as methyl, ethyl and propyl, chlorine, bromine and phenyl. In some cases, it is desirable to avoid an amino group as a substituent. The amino group, in some cases, provides an overly active reducing agent.

It is desirable, in some cases, to employ a so-called toning agent, also known as an activator-toning agent, in the photothermographic materials of the invention. Useful toning agents are described, for example, in Belgian Pat. No. 766,590 issued June 15, 1971 and in *Research Disclosure*, January, 1973, pages 16–21. Combinations of toning agents can be employed in the photothermographic materials according to the invention if desired. Typical toning agents include, for example, phthalimide, N-hydroxyphthalimide, N-potassium phthalimide, succinimide, N-hydroxy-1,8-naphthalimide, and N-hydroxysuccinimide. In some cases other toning agents can be employed such as 1-(2H)-phthalazinone and 2-acetylphthalazinone and the like. Combinations of toning agents can be employed if desired.

A combination or mixture of stabilizer precursors can also be used in the photothermographic materials of the invention.

In addition to combinations of stabilizers within the described formula according to the invention, other image stabilizers or stabilizer precursors can in some cases be employed with the stabilizer precursors of the invention. Typical stabilizer precursors which can be employed in combination with the stabilizer precursors of the invention include, for example, azole thioethers and blocked azoline thione stabilizer precursors as described in Belgian Pat. No. 768,071 issued July 30, 1971, and in copending U.S. application Ser. No. 435,806 of Burness et al., filed Jan. 23, 1974.

A photothermographic element or composition as described according to the invention can contain various colloids and polymers alone or in combination as vehicles, binding agents and in various layers. Suitable materials can be hydrophobic or hydrophilic. They are transparent or translucent and include both naturally-occurring substances such as proteins, for example, gelatin, gelatin derivatives, cellulose derivatives, polysaccharides such as dextran, gum arabic and the like; and synthetic polymeric substances such as water soluble polyvinyl compounds like poly(vinyl pyrrolidone), acrylamide polymers and the like. Other synthetic polymeric compounds which can be employed include dispersed vinyl compounds such as in latex form and particularly those which increase dimensional stability of photographic materials. Effective polymers include water-insoluble polymers of alkyl acrylates and methacrylates, acrylic acid, sulfoalkyl acrylates, methacrylates and those which have crosslinking sites which facilitate hardening or curing as well as those having recurring sulfobetaine units as described in Canadian Pat. No. 744,054. Especially useful high molecular weight materials and resins include poly(vinyl butyral), cellulose acetate butyrate, poly(methyl methacrylate), poly(vinyl pyrrolidone), ethylcellulose, poly(styrene), poly(vinyl chloride), chlorinated rubber, poly(isobutylene), butadiene-styrene copolymers, vinyl chloride-vinyl acetate copolymers, copolymers of vinyl acetate, vinyl chloride and maleic acid and poly(vinyl alcohol).

The useful concentration of reducing agent according to the invention will vary depending upon the particular photographic element, desired image, processing conditions, particular stabilizer precursor employed and the like. A useful concentration of reducing agent is typically from about 0.2 mole to about 2.0 moles of reducing agent per mole of photosensitive salt. A useful concentration of reducing agent in relationship to oxidizing agent, such as silver behenate or silver stearate, is typically from about 0.01 mole to about 20 moles of reducing agent per mole of silver salt of a long-chain fatty acid, such as per mole of silver behenate, in the photothermographic material. Reducing agents can be employed in combination. When combinations are employed, the total concentration of reducing agent is typically within the described concentration range.

Photothermographic materials according to the invention can contain development modifiers that function as speed-increasing compounds, hardeners, antistatic layers, plasticizers and lubricants, coating aids, brighteners, spectral sensitizing dyes, absorbing and filter dyes, also as described in the *Product Licensing Index*, Volume 92, December, 1971, publication 9232, pages 107–110.

The photothermographic elements according to the invention can comprise a wide variety of supports. Typical supports include cellulose nitrate film, cellulose ester film, poly(vinyl acetal) film, poly(styrene) film, poly(ethylene terephthalate) film, poly(carbonate) film, polyester films as described in U.S. Pat. No. 3,725,070 of Hamb et al., issued Apr. 3, 1973 and U.S. Pat. No. 3,634,089 of Hamb, issued Jan. 11, 1972 and related films or resinous materials, as well as glass, paper, metal and the like supports which can withstand the processing temperatures employed according to the invention. Typically a flexible support is employed.

The photothermographic compositions and other compositions according to the invention can be coated on a suitable support by various coating procedures including dip coating, air knife coating, curtain coating or extrusion coating using hoppers such as described in U.S. Pat. No. 2,681,294 of Beguin issued June 15, 1954. If desired, two or more layers can be coated simultaneously such as described in U.S. Pat. No. 2,761,791 of Russell issued Sept. 4, 1956 and British Pat. No. 837,095.

Spectral sensitizing dyes can be used in the described photothermographic elements and compositions of the invention to confer additional sensitivity to the elements and compositions of the invention. Useful sensitizing dyes are described, for example, in the *Product Licensing Index*, Volume 92, December, 1971, publication 9232, pages 107–110, paragraph XV.

After imagewise exposure of the photothermographic element according to the invention, typically to visible light, the resulting latent image can be developed merely by overall heating the element to moderately elevated temperatures. This overall heating merely involves heating the described element to a temperature within the range of from about 80° to about 250°C. such as for about 0.5 to about 60 seconds. By increasing or decreasing the length of time of heating, a higher or lower temperature within the described range can be employed depending upon the desired image, particular stabilizer precursor, particular reducing agent, and the like. Typically, a lower processing temperature is desired. A preferred processing temperature range is from about 115° to about 175°C. A developed image is typically produced within several seconds, such as from about 0.5 seconds to about 60 seconds.

Any suitable means can be used for providing the desired processing temperature range. The heating means can be a simple hot plate, iron, roller or the like.

Processing is usually carried out under ambient conditions of pressure and humidity. Conditions outside normal atmospheric pressure and humidity can be employed if desired.

The described stabilizer precursor according to the invention can be in any suitable location in the photothermographic material according to the invention which provides the desired stabilized image. If desired, one or more of the components of the photothermographic element according to the invention can be in one or more layers of the element. For example, in some cases, it can be desirable to include certain percentages of the reducing agent, toner, image stabilizer precursor and/or other addenda in a protective layer over the photothermographic element. This in some cases can reduce migration of certain addenda in the layers of the photothermographic element.

The following examples are included for a further understanding of the invention.

EXAMPLE 1

This was a comparative example.

A silver behenate-behenic acid dispersion (I) was prepared by ball-milling the following components for 64 hours:

| | |
|---|---|
| silver behenate | 168 g |
| behenic acid | 64 g |
| poly(vinyl butyral) | 120 g |
| acetone-toluene (1:1 by volume) | 2 liters |

The following addenda were combined with 71 ml of the above-identified dispersion (I), mixed thoroughly and then coated on a suitable paper support at 0.86 g Ag/m² and 2.5 g poly(vinyl butyral)/m².

| | |
|---|---|
| Poly(vinyl butyral)-silver bromoiodide emulsion 3 l./mole Ag, 100 g polymer/mole Ag, 6 mole % iodide | 11 ml |
| Acetone solution containing 10% by weight 2,6-dichloro-4-benzenesulfonamidophenol | 12 ml |
| Acetone-toluene-methanol solution (1:1:1 by volume) containing 0.5% by weight N-hydroxy-1,8-naphthalimide | 11 ml |
| Acetone | 12 ml |

The material was also overcoated with the following composition at 0.95 g cellulose acetate/m².

| | |
|---|---|
| cellulose acetate | 20.0 g |
| colloidal silica (CAB-O-SIL, produced by Cabot Co., U.S.A.) | 2.0 g |
| acetone-dichloromethane (1:1 by volume) | 800 ml |

The dried element was exposed imagewise to tungsten light for four seconds and then heat-processed by contacting the element with a metal block heated to 140°C. for 2 seconds.

After a sensitometric curve was obtained of the freshly processed sample, the coating was subjected to roomlight (about 50–60 ft.-candles from a white fluorescent bulb) for 1, 2, 4, 24, 48, and 144 hours, respectively. After each time interval a new sensitometric curve was plotted from the processed sample. The DMin and Dmax values are listed in following Table I.

EXAMPLES 2–5

Examples 2–5 are like Example 1 except that the coatings contained the concentration of α-bromo-γ-nitro-β-phenylbutyrophenone listed in following Table I. These coatings were imagewise exposed, heat processed and subjected to the roomlight handling as described for Example 1. The results are given in following Table I.

Table I

| Ex. | None | Print-Up Time and Dmin 1 hr. | 2 hr. | 4 hr. | 24 hr. | 48 hr. | 144 hr. | Dmax | mole(s) of the stabilizer precursor compound/mole Ag |
|---|---|---|---|---|---|---|---|---|---|
| 1 (comparative example) | 0.24 | 0.30 | 0.30 | 0.30 | 0.36 | 0.36 | 0.38 | 1.40 | none |
| 2 | 0.23 | 0.29 | 0.28 | 0.28 | 0.28 | 0.28 | 0.25 | 1.38 | 0.088 |
| 3 | 0.25 | 0.28 | 0.30 | 0.28 | 0.28 | 0.26 | 0.22 | 1.38 | 0.175 |
| 4 | 0.27 | 0.32 | 0.32 | 0.32 | 0.32 | 0.24 | 0.20 | 1.36 | 0.263 |
| 5 | 0.26 | 0.30 | 0.30 | 0.30 | 0.25 | 0.23 | 0.20 | 1.26 | 0.351 |

Exposed 4 seconds to tungsten light.
Processed 2 seconds/140°C.

EXAMPLES 6–11

The procedure described in Example 1 was repeated except that the concentration of the compounds listed in following Table II was added to the described photothermographic composition before coating. The results are given in Table II.

Table II

| Example No. | Stabilizer Precursor Compound | mole of compound/ mole Ag | Print-Up Time and Dmin | | | | | | | Dmax |
|---|---|---|---|---|---|---|---|---|---|---|
| | | | Fresh | 1 hr | 2 hr | 4 hr | 24 hr | 48 hr | 120 hr | |
| 6 | none | — | 0.17 | 0.26 | 0.26 | 0.26 | 0.29 | 0.31 | 0.32 | 1.21 |
| 7 | H* | 0.175 | 0.18 | 0.25 | 0.25 | 0.24 | 0.20 | 0.19 | 0.18 | 1.26 |
| 8 | M** | 0.449 | 0.18 | 0.22 | 0.22 | 0.22 | 0.22 | 0.22 | 0.22 | 1.29 |
| 9 (comparative example) | Z*** | 0.025 | 0.18 | 0.25 | 0.26 | 0.26 | 0.28 | 0.30 | 0.30 | 1.29 |
| 10 (comparative example) | Z*** | 0.075 | 0.20 | 0.25 | 0.27 | 0.28 | 0.28 | 0.28 | 0.27 | 1.20 |
| 11 (comparative example) | Z*** | 0.140 | 0.20 | 0.27 | 0.30 | 0.30 | 0.29 | 0.28 | 0.27 | 1.29 |

*Compound H: α-bromo-γ-nitro-β-phenylbutyrophenone
**Compound M: α-chloro-p-phenylacetophenone
***Compound Z: 1,2,3,4-tetrabromobutane The results in Table II illustrate that 1,2,3,4-tetrabromobutane does not stabilize the above-described photothermographic material of Example 1 as efficiently as the monohalogenated compounds H and M.

EXAMPLES 12–14

These examples are approximately an equimolar comparison (0.4 mole/mole total Ag) between compound M and 1,2,3,4-tetrabromobutane. The coatings were imagewise exposed, heat-processed and tested as described in Example 1. Table III lists the sensitometric results.

Table III

| Example No. | Stabilizer Precursor Compound | mole of compound mole Ag | Fresh | Print-Up Time and Dmin | | | | | Dmax |
|---|---|---|---|---|---|---|---|---|---|
| | | | | 1 hr | 2 hr | 4 hr | 24 hr | 96 hr | |
| 12 | none | — | 0.16 | 0.26 | 0.27 | 0.27 | 0.30 | 0.32 | 1.22 |
| 13 | M | 0.45 | 0.16 | 0.24 | 0.24 | 0.24 | 0.24 | 0.24 | 1.27 |
| 14 | Z | 0.43 | 0.23 | 0.32 | 0.33 | 0.33 | — | 0.29 | 1.26 |

EXAMPLES 15–27

Results similar to those of Example 2 were provided when the stabilizer precursor compound of Examples 2–5 was replaced with the following compounds.

EXAMPLE 15

2-bromo-2-phenylsulfonylacetamide

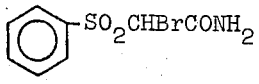

EXAMPLE 16

2-bromoacetophenone

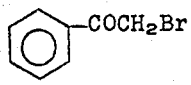

EXAMPLE 17

α-Chloro-p-nitrotoluene

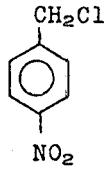

EXAMPLE 18

2,4′-Dibromoacetophenone

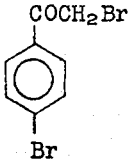

EXAMPLE 19

2-bromo-2-phenylacetophenone

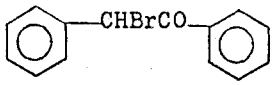

EXAMPLE 20

2-bromo-1,3-diphenyl-1,3-propanedione

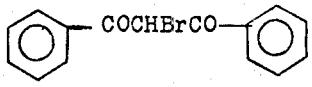

EXAMPLE 21

α-Bromo-2,5-dimethoxyacetophenone

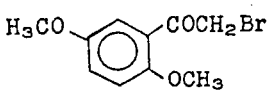

EXAMPLE 22

2-Bromo-2-p-tolylsulfonylacetamide

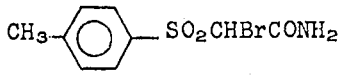

EXAMPLE 23

α-Iodo-γ-nitro-β-phenylbutyrophenone

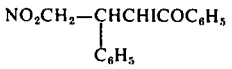

EXAMPLE 24

α-Bromo-p-nitrotoluene

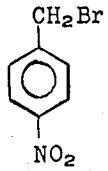

EXAMPLE 25

2-Bromo-4′-phenylacetophenone

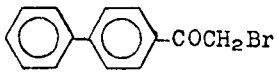

EXAMPLE 26

α-Bromo-m-nitrotoluene

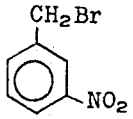

EXAMPLE 27

2-bromo-2-nitro-1,3-propanediol

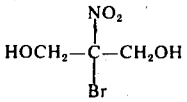

EXAMPLE 28

1,3-dibenzoyloxy-2-bromo-2-nitropropane

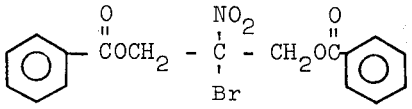

EXAMPLE 29

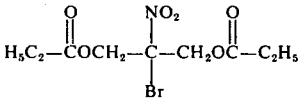

EXAMPLE 30

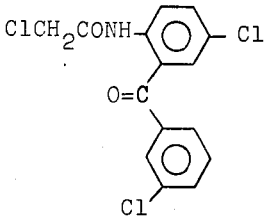

EXAMPLE 31

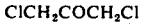

EXAMPLE 32

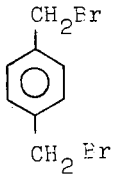

EXAMPLE 33

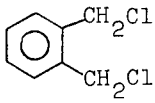

EXAMPLE 34

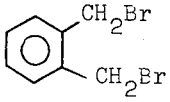

Another advantage which the described stabilizer precursors provide in silver halide photothermographic materials is that they provide enhanced shelf-life or incubation stability at elevated temperatures.

EXAMPLES 35–39

A silver behenate dispersion was prepared by mixing the following components in a Waring Blender and then passing the dispersion twice through a Manton-Gaulin Homogenizer at 4,000 psi:

| | |
|---|---|
| silver behenate | 55 g |
| poly(vinyl butyral) | 15 g |
| methyl isobutyl ketone | 500 ml |

A photothermographic material was prepared by combining the following addenda and coating on an unsubbed polyethylene terephthalate film support at 10.76 mg Ag/dm²:

| | |
|---|---|
| silver behenate dispersion (preparation described above) | 160 ml |
| acetone solution containing 7.5% by weight succinimide | 18.4 ml |
| acetone solution containing 14% by weight poly(vinyl butyral) | 37 ml |
| poly(vinyl butyral)-silver bromide emulsion (90 g polymer/mole Ag, 3 l/mole Ag) | 74 ml |

The above element was also overcoated with poly[4-,4'-(hexahydro-4,7-methanoindan-5-ylidine)diphenylene carbonate] at a coverage of 11.84 mg/dm².

The dried element was exposed sensitometrically for $10^{-3}$ sec. with a Mark VII exposing device marketed by Edgerton, Germeshausen and Grier, Inc. and then overall heated for 5 seconds at 135°C. Another sample of the same film was stored for 1 week at 37.8°C/50% relative humidity, exposed for $10^{-3}$ seconds and heat-processed for 5 seconds at 135°C. The sensitometric data was shown in the following Table IV.

Examples 36–39 are like Example 35 except that the film materials now contain 0.0035 mole, 0.0105 mole and 0.0350 mole of 2-bromo-2-p-tolylsulfonylacetamide (Example 22) per mole of total silver, respectively. The materials are tested in the same manner as described in Example 35. See Table IV for the sensitometric data.

Table IV

| Example | Fresh *Relative Speed | Dmin | 1 wk/37.8°C/50%RH Relative Speed | Dmin | Mole of halogen compound/mole Total Silver |
|---|---|---|---|---|---|
| 30 | 100 | 0.25 | — | 0.92 | None |
| 31 | 110 | 0.23 | 68 | 0.55 | 0.0035 |
| 32 | 89 | 0.20 | 107 | 0.26 | 0.0105 |
| 33 | 87 | 0.26 | 87 | 0.25 | 0.0350 |

*speed measured at 0.30 above Dmin

The above results demonstrate that the described halogenated compounds can also function as incubation stabilizer precursors.

Other halo compounds which are not within the described generic structure (I) but which can function as printout stabilizer precursors are as follows:

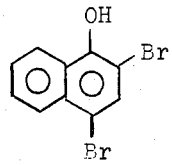

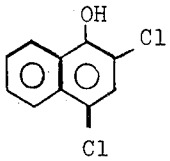

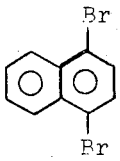

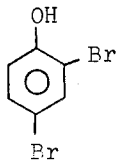

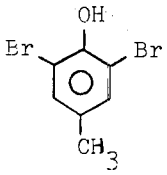

The invention has been described in detail with particular reference to preferred embodiments thereof, but it will be understood that variations and modifications can be effected within the spirit and scope of the invention.

What is claimed is:

1. In a photothermographic element comprising a support having thereon a layer comprising (a) photosensitive silver halide in association with (b) an oxidation-reduction image-forming combination comprising (i) an oxidizing agent comprising a heavy metal salt oxidizing agent with (ii) an organic reducing agent, (c) a polymeric binder for the layer, and (d) a halogen containing organic stabilizer precursor, the improvement wherein said stabilizer precursor comprises a stabilizing concentration of a compound represented by the formula:

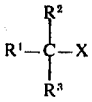

wherein X is chloro, bromo or iodo; $R^1$, $R^2$ and $R^3$ are each hydrogen; alkyl containing 1 to 10 carbon atoms; hydroxyalkyl containing 1 to 10 carbon atoms; acyloxyalkyl containing 2 to 10 carbon atoms; nitro; nitroalkyl containing 1 to 10 carbon atoms; aryl containing 6 to 12 carbon atoms; acyl of the formula $R^4$—CO— wherein $R^4$ is alkyl containing 1 to 5 carbon atoms, or aryl containing 6 to 12 carbon atoms; amido of the formula:

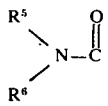

wherein $R^5$ and $R^6$ are each hydrogen, alkyl containing 1 to 5 carbon atoms, phenyl or naphthyl; sulfonyl represented by the formula $R^7$—$SO_2$— wherein $R^7$ is alkyl containing 1 to 5 carbon atoms or aryl containing 6 to 12 carbon atoms; and wherein at least one of $R^1$, $R^2$ and $R^3$ is a stabilizer precursor activating substituent.

2. A photothermographic element as in claim 1 wherein at least one of $R^1$, $R^2$ and $R^3$ in said stabilizer precursor is nitro, nitroalkyl, acyl, amido or sulfonyl as defined in claim 1.

3. A photothermographic element as in claim 1 wherein said stabilizer precursor comprises an alpha-monohaloketone represented by the formula:

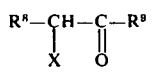

wherein X is chloro, bromo or iodo; $R^8$ is hydrogen, alkyl containing 1 to 10 carbon atoms, acyl containing 1 to 10 carbon atoms, and aryl containing 6 to 12 carbon atoms; $R^9$ is amino, alkyl containing 1 to 10 carbon atoms and aryl containing 6 to 12 carbon atoms.

4. A photothermographic element as in claim 1 wherein said stabilizer precursor comprises a monohalo sulfonyl compound represented by the formula:

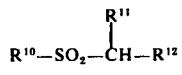

wherein $R^{10}$ is aryl containing 6 to 12 carbon atoms; $R^{11}$ is chloro, bromo or iodo; $R^{12}$ is hydrogen, alkyl containing 1 to 5 carbon atoms, amido represented by the formula

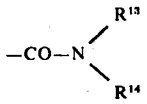

wherein $R^{13}$ and $R^{14}$ are each alkyl containing 1 to 5 carbon atoms, phenyl, tolyl or hydrogen.

5. A photothermographic element as in claim 1 wherein said stabilizer precursor comprises a monohalo nitro lower alkane represented by the formula:

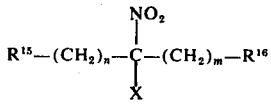

wherein X is chloro, bromo or iodo; *m* and *n* are each 1 to 5; $R^{15}$ and $R^{16}$ are each hydroxyl, an ester or a sulfonyl group represented by the formulae:

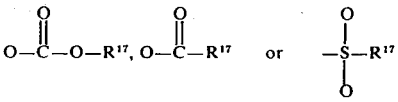

wherein $R^{17}$ is aryl containing 6 to 12 carbon atoms or alkyl containing 1 to 5 carbon atoms.

6. A photothermographic element as in claim 1 wherein said stabilizer precursor is 1,3-dibenzoyloxy-2-bromo-2-nitropropane.

7. A photothermographic element as in claim 1 wherein said stabilizer precursor is alpha-bromo-gamma-nitrobeta-phenylbutyrophenone.

8. A photothermographic element as in claim 1 wherein said stabilizer precursor is 2-bromo-2-p-tolylsulfonylacetamide.

9. A photothermographic element as in claim 1 wherein said stabilizer precursor is 2-bromo-2-nitro-1,3-propanediol.

10. A photothermographic element as in claim 1 wherein said stabilizer precursor is alpha-chloro-p-nitrotoluene.

11. A photothermographic element as in claim 1 comprising about 0.01 to about 1.0 mole of said stabilizer precursor per mole of total silver.

12. A photothermographic element as in claim 1 comprising about 0.05 to about 0.75 mole of said photosensitive silver halide, about 0.05 to about 0.75 mole of said organic reducing agent, and about 0.01 to about 1.0 mole of said stabilizer precursor per mole of total silver.

13. A photothermographic composition comprising (a) photosensitive silver halide in association with (b) an oxidation-reduction image-forming combination comprising (i) an oxidizing agent comprising a heavy metal salt oxidizing agent with (ii) an organic reducing agent, (c) a polymeric binder, and (d) a halogen containing organic stabilizer precursor, the improvement wherein said stabilizer precursor comprises a stabilizing concentration of a compound represented by the formula:

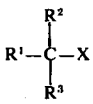

wherein X is chloro, bromo or iodo; $R^1$, $R^2$ and $R^3$ are each hydrogen; alkyl containing 1 to 10 carbon atoms; hydroxyalkyl containing 1 to 10 carbon atoms; acyloxyalkyl containing 2 to 10 carbon atoms; nitro; nitroalkyl containing 1 to 10 carbon atoms; aryl containing 6 to 12 carbon atoms; acyl of the formula $R^4$—CO— wherein $R^4$ is alkyl containing 1 to 5 carbon atoms, or aryl containing 6 to 12 carbon atoms; amido of the formula

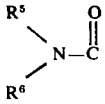

wherein $R^5$ and $R^6$ are each hydrogen, alkyl containing 1 to 5 carbon atoms, phenyl or naphthyl; sulfonyl represented by the formula $R^7—SO_2—$ wherein $R^7$ is alkyl containing 1 to 5 carbon atoms or aryl containing 6 to 12 carbon atoms; and wherein at least one of $R^1$, $R^2$ and $R^3$ is a stabilizer precursor activating substituent.

14. A photothermographic composition as in claim 13 wherein at least one of $R^1$, $R^2$ and $R^3$ in said stabilizer precursor is nitro, nitroalkyl, acyl, amido or sulfonyl as defined in claim 13.

15. A photothermographic composition as in claim 13 wherein said stabilizer precursor comprises an alpha-monohaloketone represented by the formula:

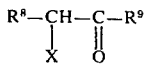

wherein X is chloro, bromo or iodo; $R^8$ is hydrogen, alkyl containing 1 to 10 carbon atoms, acyl containing 1 to 10 carbon atoms, and aryl containing 6 to 12 carbon atoms; $R^9$ is amino, alkyl containing 1 to 10 carbon atoms and aryl containing 6 to 12 carbon atoms.

16. A photothermographic composition as in claim 13 wherein said stabilizer precursor comprises a monohalo sulfonyl compound represented by the formula:

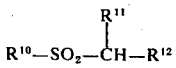

wherein $R^{10}$ is aryl containing 6 to 12 carbon atoms; $R^{11}$ is chloro, bromo or iodo; $R^{12}$ is hydrogen, alkyl containing 1 to 5 carbon atoms, amido represented by the formula:

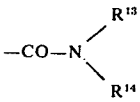

wherein $R^{13}$ and $R^{14}$ are each alkyl containing 1 to 5 carbon atoms, phenyl, tolyl or hydrogen.

17. A photothermographic composition as in claim 13 wherein said stabilizer precursor comprises a monohalo nitro lower alkane represented by the formula:

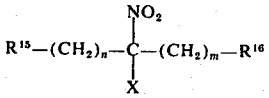

wherein X is chloro, bromo or iodo; *m* and *n* are each 1 to 5; $R^{15}$ and $R^{16}$ are each hydroxyl, an ester or a sulfonyl group represented by the formulae:

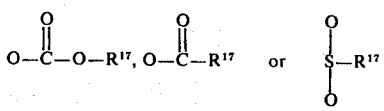

wherein $R^{17}$ is aryl containing 6 to 12 carbon atoms or alkyl containing 1 to 5 carbon atoms.

18. A photothermographic composition as in claim 13 wherein said stabilizer precursor is 1,3-dibenzoyloxy-2-bromo-2-nitropropane.

19. A photothermographic composition as in claim 13 wherein said stabilizer precursor is alpha-bromo-gamma-nitrobeta-phenylbutyrophenone.

20. A photothermographic composition as in claim 13 wherein said stabilizer precursor is 2-bromo-2-p-tolylsulfonylacetamide.

21. A photothermographic composition as in claim 13 wherein said stabilizer precursor is 2-bromo-2-nitro-1,3-propanediol.

22. A photothermographic composition as in claim 13 wherein said stabilizer precursor is alpha-chloro-p-nitrotoluene.

23. A photothermographic composition as in claim 13 comprising about 0.01 to about 1.0 mole of said stabilizer precursor per mole of total silver.

24. A photothermographic composition as in claim 13 comprising about 0.05 to about 0.75 mole of said photosensitive silver halide, about 0.05 to about 0.75 mole of said organic reducing agent, and about 0.01 to about 1.0 mole of said stabilizer precursor per mole of total silver.

25. A photothermographic composition comprising (a) an oxidation-reduction image-forming combination comprising (i) silver behenate with (ii) a sulfonamidophenol reducing agent, (b) photosensitive silver halide, (c) poly(vinyl butyral) binder, (d) about 0.20 to about 0.85 mole of 2-bromo-2-p-tolylsulfonylacetamide per mole of total silver in said composition.

26. A photothermographic composition comprising (a) an oxidation-reduction image-forming combination comprising (i) silver behenate with (ii) a sulfonamidophenol reducing agent, (b) photosensitive silver halide, (c) poly(vinyl butyral) binder, (d) about 0.05 to about 0.50 mole of 2-bromo-2-nitro-1,3-propanediol per mole of total silver in said composition.

27. A process of developing a stable image in an imagewise-exposeed photothermographic element comprising a support having thereon a layer comprising (a) an oxidation-reduction image-forming combination comprising (i) an oxidizing agent comprising a silver salt of a long-chain fatty acid with (ii) an organic reducing agent, (b) photosensitive silver halide, (c) a polymeric binder, and (d) a halogen-containing organic stabilizer precursor comprising a stabilizing concentration of a compound represented by the formula:

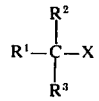

wherein X is chloro, bromo or iodo; $R^1$, $R^2$ and $R^3$ are each hydrogen; alkyl containing 1 to 10 carbon atoms; hydroxyalkyl containing 1 to 10 carbon atoms; acyloxyalkyl containing 2 to 10 carbon atoms; nitro; nitroalkyl containing 1 to 10 carbon atoms; aryl containing 6 to 12 carbon atoms; acyl of the formula $R^4—CO—$ wherein $R^4$ is alkyl containing 1 to 5 carbon atoms, or aryl containing 6 to 12 carbon atoms; amido of the formula:

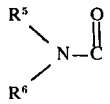

wherein $R^5$ and $R^6$ are each hydrogen, alkyl containing 1 to 5 carbon atoms, phenyl or naphthyl; sulfonyl represented by the formula $R^7—SO_2—$ wherein $R^7$ is alkyl containing 1 to 5 carbon atoms or aryl containing 6 to 12 carbon atoms; and wherein at least one of $R^1$, $R^2$ and $R^3$ is a stabilizer precursor activating substituent; comprising heating said element to a temperature from about 80° to about 250° C.

28. A process as in claim 27 comprising heating said element from about 80° to about 250°C. for about 0.5 to about 60 seconds.

29. A process of developing a stable image as in claim 27 in an imagewise-exposed photothermographic element comprising a support having thereon a layer comprising (a) an oxidation-reduction image-forming combination comprising (i) silver behenate with (ii) a sulfonamidophenol reducing agent, (b) photosensitive silver halide, (c) a poly(vinyl butyral) binder, and (d) about 0.20 mole to about 0.85 mole of 2-bromo-2-p-tolylsulfonylacetamide per mole of total silver in said element comprising heating said element to a temperature from about 120°C. to about 160°C. for about 0.5 to about 30 seconds.

30. A process of developing a stable image as in claim 27 in an imagewise-exposed photothermographic element comprising a support having thereon a layer comprising (a) an oxidation-reduction image-forming combination comprising (i) silver behenate with (ii) a sulfonamidophenol reducing agent, (b) photosensitive silver halide, (c) a poly(vinyl butyral) binder, and (d) about 0.05 mole to about 0.50 mole of 2-bromo-2-nitro-1,3-propanediol per mole of total silver in said element comprising heating said element to a temperature from about 120° to about 160°C. for about 0.5 to about 30 seconds.

* * * * *

UNITED STATES PATENT AND TRADEMARK OFFICE

CERTIFICATE OF CORRECTION

PATENT NO. : 3,955,982

DATED : May 11, 1976

INVENTOR(S) : James A. VanAllan, Ronald H. Ericson and Lorenzo F. Costa

It is certified that error appears in the above-identified patent and that said Letters Patent are hereby corrected as shown below:

Column 1, line 55, "HCL" should read ---HCl---.

Column 7, line 51, "grammma" should read ---gamma---.

Column 17, lines 38-39, "2-bromo-2-p-tolylsulfonyl-actiamide" should read --- 2-bromo-2-p-tolylsulfonyl-acetamide ---.

Column 22, line 43, "exposeed" should read ---exposed---.

Signed and Sealed this

Fourteenth Day of September 1976

[SEAL]

*Attest:*

RUTH C. MASON
*Attesting Officer*

C. MARSHALL DANN
*Commissioner of Patents and Trademarks*